US008146373B2

(12) United States Patent
Snow, III

(10) Patent No.: US 8,146,373 B2
(45) Date of Patent: Apr. 3, 2012

(54) ACCESSORY SUB-COOLING UNIT AND METHOD OF USE

(76) Inventor: Amos A. Snow, III, Longview, TX (US)

( * ) Notice: Subject to any disclaimer, the term of this patent is extended or adjusted under 35 U.S.C. 154(b) by 551 days.

(21) Appl. No.: 12/401,227

(22) Filed: Mar. 10, 2009

(65) Prior Publication Data

US 2009/0223231 A1 Sep. 10, 2009

Related U.S. Application Data

(60) Provisional application No. 61/068,704, filed on Mar. 10, 2008.

(51) Int. Cl.
*F25B 45/00* (2006.01)

(52) U.S. Cl. ..... 62/77; 62/428

(58) Field of Classification Search ..... 62/77, 426, 62/428, 498, 513; 165/181, 182
See application file for complete search history.

(56) References Cited

U.S. PATENT DOCUMENTS

| | | | | |
|---|---|---|---|---|
| 3,173,479 | A | 3/1965 | Heuer | |
| 3,177,929 | A | 4/1965 | Jennings | |
| 3,866,439 | A | 2/1975 | Bussjager et al. | |
| 4,040,268 | A | 8/1977 | Howard | |
| 4,067,205 | A | 1/1978 | Mayhue | |
| 4,201,065 | A | 5/1980 | Griffin | |
| 4,404,814 | A | 9/1983 | Beasley et al. | |
| 4,995,453 | A | 2/1991 | Bartlett | |
| 5,069,043 | A | 12/1991 | Wachs, III et al. | |
| 5,622,057 | A * | 4/1997 | Bussjager et al. | 62/173 |
| 5,992,160 | A | 11/1999 | Bussjager et al. | |
| 6,116,048 | A | 9/2000 | Hebert | |
| 6,385,985 | B1 * | 5/2002 | Bussjager et al. | 62/259.1 |
| 6,651,451 | B2 * | 11/2003 | Cho et al. | 62/197 |
| 6,701,723 | B1 * | 3/2004 | Dobmeier et al. | 62/90 |
| 6,761,039 | B1 | 7/2004 | Gray | |
| 6,904,767 | B1 * | 6/2005 | Wright | 62/427 |

(Continued)

FOREIGN PATENT DOCUMENTS

GB 2091401 A * 7/1982

OTHER PUBLICATIONS

Marshall Brain, How Air Conditioners Work, Howstuffworks, http://home.howstuffworks.com/ac.htm/printable.
Vapor-compression Refrigeration—Wikipedia, the free encyclopedia, http://en.wikipedia.org/wiki/Vapor-compression_refrigeration.
Air conditioner—Wikipedia, the free encyclopedia, http://en.wikipedia.org/wiki/Air_conditioner.

(Continued)

*Primary Examiner* — Mohammad Ali
(74) *Attorney, Agent, or Firm* — David W. Carstens; Jeffrey G. Degenfelder; Carstens & Cahoon, LLP

(57) ABSTRACT

A system and method for improving the efficiency of a refrigerated air conditioning system utilizing a vapor-compression refrigeration cycle. The improved system includes an accessory sub-cooling unit which is fluidly connected between the condensing coil and the expansion valve in a closed loop refrigeration system utilizing a vapor-compression refrigeration cycle. The accessory sub-cooling unit comprises a serpentine heat exchange tube having one end fluidly connected downstream of the condensing coil prior to the expansion valve. The accessory sub-cooling unit further comprises a plurality of parallel planar heat transfer fins to assist the heat transfer from the heat exchange tube to the ambient air. In accordance with the method of the present invention, the accessory sub-cooling unit is mounted to a side of the condenser unit in order to utilize the existing air flow generated by the exhaust fan of the condenser unit.

6 Claims, 4 Drawing Sheets

U.S. PATENT DOCUMENTS

| | | | | |
|---|---|---|---|---|
| 7,032,411 | B2 | 4/2006 | Hebert | |
| 7,055,590 | B2 * | 6/2006 | Hara | 165/202 |
| 7,061,446 | B1 * | 6/2006 | Short et al. | 343/893 |
| 7,726,151 | B2 * | 6/2010 | Manole | 62/513 |
| 2003/0196445 | A1 * | 10/2003 | Cho et al. | 62/197 |
| 2003/0217567 | A1 * | 11/2003 | Oh et al. | 62/507 |
| 2004/0011068 | A1 * | 1/2004 | Hatakeyama | 62/228.1 |
| 2005/0198976 | A1 * | 9/2005 | Wright | 62/93 |
| 2005/0204772 | A1 * | 9/2005 | Patel et al. | 62/509 |
| 2007/0235161 | A1 | 10/2007 | Barger et al. | |

OTHER PUBLICATIONS

How Does an Air Conditioner Work? http://www.energyquest.ca.gov/how__it__works/air__conditioner.html.

Marshall Brain, How Air Conditioners Work, Split-system AC Units, http://home.howstuffworks.com/ac3.htm.

Trane: View Inside Products, Durability by Design, 2008 Trane, file:///Q:/My%20Documents/Other%20Clients/Snow,%20Amos/A . . .

A Look Inside: The Rheem Condensing Unit.

* cited by examiner

ACCESSORY SUB-COOLING UNIT AND METHOD OF USE

CROSS-REFERENCE TO RELATED APPLICATION

This application claims the benefit of and priority to a U.S. Provisional Patent Application No. 61/068,704 filed Mar. 10, 2008, the technical disclosure of which is hereby incorporated herein by reference.

BACKGROUND OF THE INVENTION

1. Technical Field

The present invention relates generally to refrigerant based heat exchange systems, and more particularly vapor compression refrigeration systems employing a compressor, a condenser, an evaporator and associated fluid circuitry used for air conditioning, food storage refrigeration, and similar applications, and to improvements which result from subcooling the refrigerant prior to it reaching the evaporator.

2. Description of the Related Art

The use of refrigerated air conditioning systems in commercial and residential property has become commonplace and ubiquitous. Indeed, particularly in the South and Southwest, it borders on being a necessity for ordinary life. Over the years, a variety of different air conditioning systems have been developed for cooling interior spaces. For example, in particularly arid regions, evaporative coolers are effective air conditioners, while large commercial buildings oftentimes rely upon air conditioning systems commonly known as chilled-water systems. Perhaps the most widely employed air conditioning system used today is what is commonly termed refrigerated air.

Refrigerated air conditioning systems utilize a thermal transfer cycle commonly referred to as the vapor-compression refrigeration cycle. Such systems typically include a compressor, a condenser, an expansion or throttling device and an evaporator connected in serial fluid communication with one another forming an air conditioning or refrigeration circuit. The system is charged with a condensable refrigerant (e.g., R-22 or R-410A), which circulates through each of the components in a closed loop. More particularly, the refrigerant of the system circulates through each of the components to remove heat from the evaporator and transfer heat to the condenser. The compressor compresses the refrigerant from a low-pressure superheated vapor state to a high pressure superheated vapor thereby increasing the temperature, enthalpy and pressure of the refrigerant. A superheated vapor is a vapor that has been heated above its boiling point temperature. The refrigerant then leaves the compressor and enters the condenser as a vapor at some elevated pressure where it is condensed as a result of heat transfer to cooling water and/or ambient air. The refrigerant then flows through the condenser condensing the refrigerant at a substantially constant pressure to a saturated-liquid state. The refrigerant then leaves the condenser as a high pressure liquid. The pressure of the liquid is decreased as it flows through the expansion or throttling valve causing the refrigerant to change to a mixed liquid-vapor state. The remaining liquid, now at low pressure, is vaporized in the evaporator as a result of heat transfer from the refrigerated space. This low-pressure superheated vapor refrigerant then enters the compressor to complete the cycle.

While all refrigerated air conditioning systems operate in accordance with the same general principals, there are a multitude of specific configurations adapted to particular uses.

With regard to residential and smaller commercial building applications, one system in particular, commonly known as the "split-system," has become quite prevalent. As its name implies, split-system air conditioners split the "hot" side from the "cold" side of the vapor-compression refrigeration cycle. The hot side of the system, known as the condensing unit, is placed outside the building and comprises a compressor, a condenser heat exchange coil and a fan to disperse the heat generated by the system. The cold side of the system, comprising an expansion valve and evaporator coil, is generally placed in an air handler unit, such as the furnace or some other air circulating device on the interior of the building. The air handler unit blows air over the evaporator coil and routes the air throughout the building using a series of ducts. Because the two major components of a split-system air conditioner are remotely located from one another, connecting lines are used to link the two components together.

For example, FIG. 1 depicts a typical split-system design of a vapor-compression refrigeration cycle used in residential applications. A house 10 is shown having an air handler unit, designated generally as 12, located on the interior of house 10 for directing conditioned air throughout the house by way of air ducts (not shown). Located within the air handler unit 12 is a throttling or expansion valve in fluid communication with an evaporator coil for evaporating the refrigerant to cool the evaporator coil so that when air is directed over the evaporator coil, the air is cooled and then distributed by the air handler around the house. A condenser unit 20, remote from air handler 12, is located outside house 10 and includes a compressor 14, a condenser coil 22, and an exhaust fan 18 housed in a protective housing. For example, as depicted in FIG. 1, the housing includes a top 21 and corners 23 constructed of sheet metal and protective wire grates 24. The exhaust fan 18 is typically powered by an electric motor 16. The exhaust fan 18 is used to create an air flow over the condenser coil 22 thereby cooling and condensing the compressed refrigerant vapor into liquid refrigerant. The condenser coil 22 typically includes a plurality of parallel planar heat transfer fins 25 to assist the heat transfer from the condenser coil to the air flow.

Thus, in accordance with a typical vapor-compression refrigeration cycle, low-pressure refrigerant vapor is compressed by the compressor 14 and fed to the condenser coil 22 where the high pressure superheated refrigerant vapor releases heat to the airflow generated by exhaust fan 18 and condenses. The high pressure condensed refrigerant then exits the condenser unit 20 and flows through a conduit 2 to the throttling or expansion valve where the pressure of the refrigerant is reduced. From the expansion device, the refrigerant passes into the evaporator coil, absorbs ambient heat from air directed over the evaporator, and vaporizes. The low-pressure superheated refrigerant vapor is then drawn back into the compressor 14 by means of return conduit 4, completing the circuit.

It is, of course, understood that the system shown in FIG. 1 is a simplified depiction of the basic components in a typical vapor-compression refrigeration cycle. Indeed, the great majority of innovations in the field of such refrigeration systems have been directed at improving the individual components of the cycle. For example, while the condenser coil 22 is depicted as a single helically wound vertically disposed coil, it is understood that, in accordance with known prior art, the condenser coil 22 may comprise a plurality of refrigerant circuits, wherein each refrigerant circuit comprises a plurality of refrigerant tubes which run transverse to the fin structure of the heat exchanger, with the ends of appropriate tubes in each circuit being connected by curved tubes or return bends. Each refrigerant circuit receives a portion of the high pressure superheated refrigerant vapor produced by the compressor 14 through a distributor valve (not shown). A collection manifold (not shown), in turn, receives the condensed refrigerant from each of the circuits, where it combines to flow through conduit 2 to the throttling or expansion valve. Likewise, compressor 14 may comprise a variable capacity compressor and electric motor 16 may include variable speed drives.

The efficient operation of refrigerated air conditioners is of continuing and ever increasing importance as energy costs continue to rise. A variety of other proposals have previously been made to improve the efficiency of refrigeration systems featuring the vapor-compression refrigeration cycle. For example, many proposals have sought to improve the heat transfer characteristics of the condensing coil. Two simple solutions include increasing the mass of the condensing coil or increasing the air flow over the condensing coil. However, both of these solutions are not economically efficient in view of present costs of materials and energy. Other attempts to provide increased efficiency have resulted in various designs for applying water to the condensing coil to improve its heat transfer characteristics and to further cool the liquid refrigerant prior to evaporation. For example, Gray U.S. Pat. No. 6,761,039, issued Jul. 13, 2004, discloses such a cooling system for spraying water onto the condensing coil.

In addition, it is also known that the subcooling of a liquid refrigerant below the temperature at which it was condensed will increase the refrigerating capacity of the compressor system due to less flash gas being produced at the expansion valve by the colder refrigerant and the increased capacity of the refrigerant for absorbing heat.

The subcooling of the liquid refrigerant is an effective means for increasing the refrigeration capacity of a given refrigeration unit. It has been found that for every 2° F. of subcooling of conventional halogenated refrigerants that takes place, the capacity of the refrigerating system will be increased by approximately one percent.

Subcooling the liquid refrigerant on the downstream or liquid side of the condenser thus holds promise if the increase in efficiency is improved to make it economically feasible. The effect of this subcooling can be visualized on the standard pressure/enthalpy chart for the standard CFC refrigerant. The cooling capacity of the refrigerant is increased as represented by the increased area on the left side within the diagram lines of the chart. The saturated liquid refrigerant is cooled beyond the reference line on the left side providing an increase in efficiency.

There have been some efforts in the prior art to use auxiliary cooling devices as subcoolers. In this effort for example, additional heat exchange coils are provided in the closed loop refrigeration system downstream of the condenser. This art typically comprises expensive and complicated counterflow heat exchanger type add-on or retrofit for existing refrigeration systems or the like. A typical system utilizing a counterflow liquid cooling coil is shown in Jennings U.S. Pat. No. 3,177,929, issued Apr. 13, 1965. While these units have been around for years, it is generally accepted that they have not been successful because the increase in efficiency of the subcooling unit working alone does not justify the cost of the unit.

A need, therefore, exists for an improved and simplified accessory sub-cooling unit and method of operation which can be easily adapted to an existing condenser unit in a refrigerated air conditioning system utilizing a vapor-compression refrigeration cycle.

SUMMARY OF THE INVENTION

The present invention overcomes many of the disadvantages of the prior art by providing a simplified, yet effective system and method for improving the efficiency of a refrigerated air conditioning system utilizing a vapor-compression refrigeration cycle. The improved system includes an accessory sub-cooling unit which is fluidly connected between the condensing coil and the expansion valve in a closed loop refrigeration system utilizing a vapor-compression refrigeration cycle. The accessory sub-cooling unit comprises a serpentine heat exchange tube having one end fluidly connected downstream of the condensing coil prior to the expansion valve. The accessory sub-cooling unit further comprises a plurality of parallel planar heat transfer fins to assist the heat transfer from the heat exchange tube to the ambient air. In accordance with the method of the present invention, the accessory sub-cooling unit is mounted to a side of the condenser unit in order to utilize the existing air flow generated by the exhaust fan of the condenser unit. Novel features of the invention include that it is an independent cooling system used only to subcool the temperature of liquid refrigerant exiting the condensing coil and that it utilizes the existing air flow generated by the exhaust fan of the condenser unit. Moreover, the accessory sub-cooling unit of the present invention is inexpensive, easy to install.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
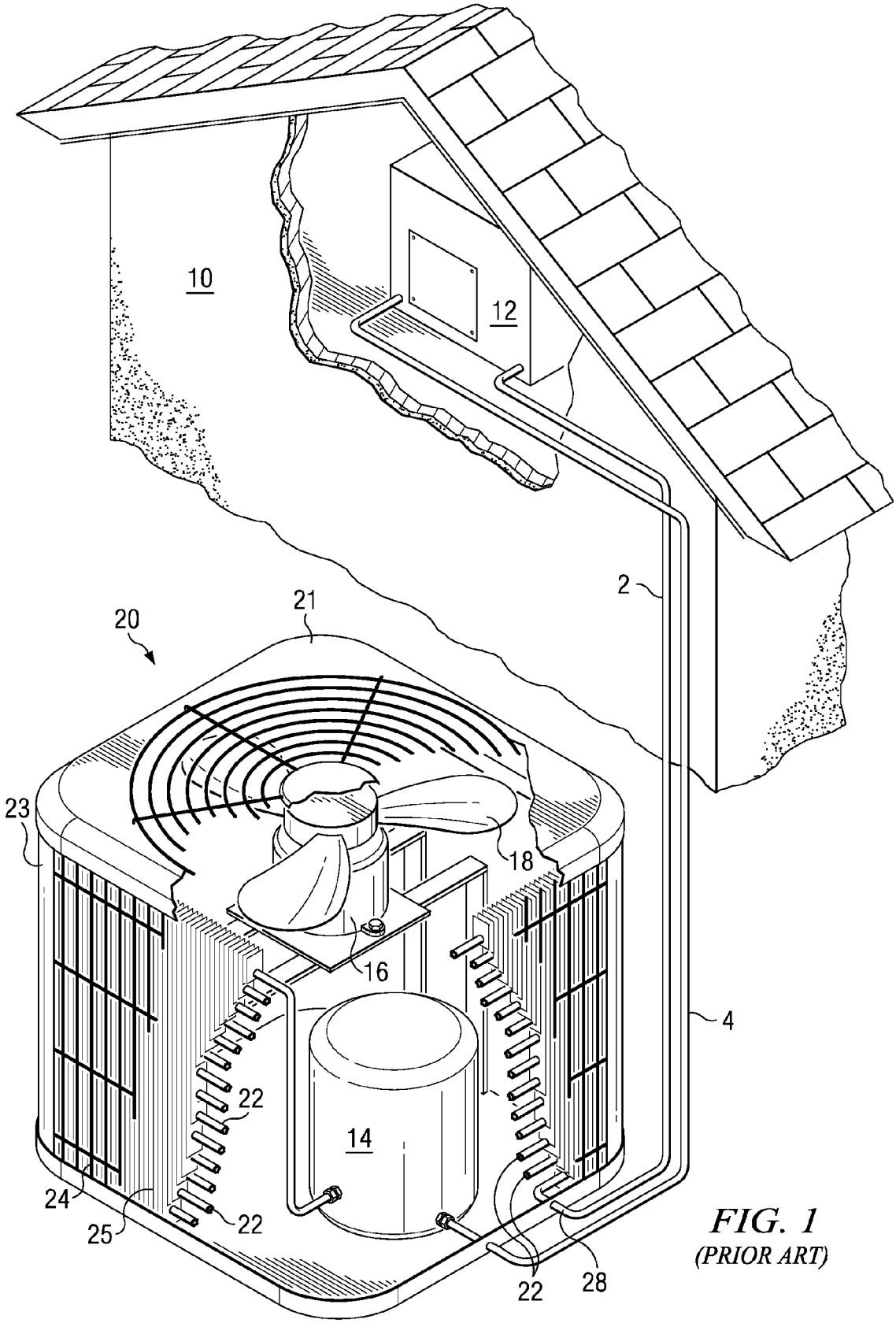
FIG. 1 (PRIOR ART)
FIG. 1 is an illustration of a typical prior art split-system design of a refrigeration system featuring a vapor-compression refrigeration cycle used in residential applications.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION OF THE INVENTION

Figure 2:
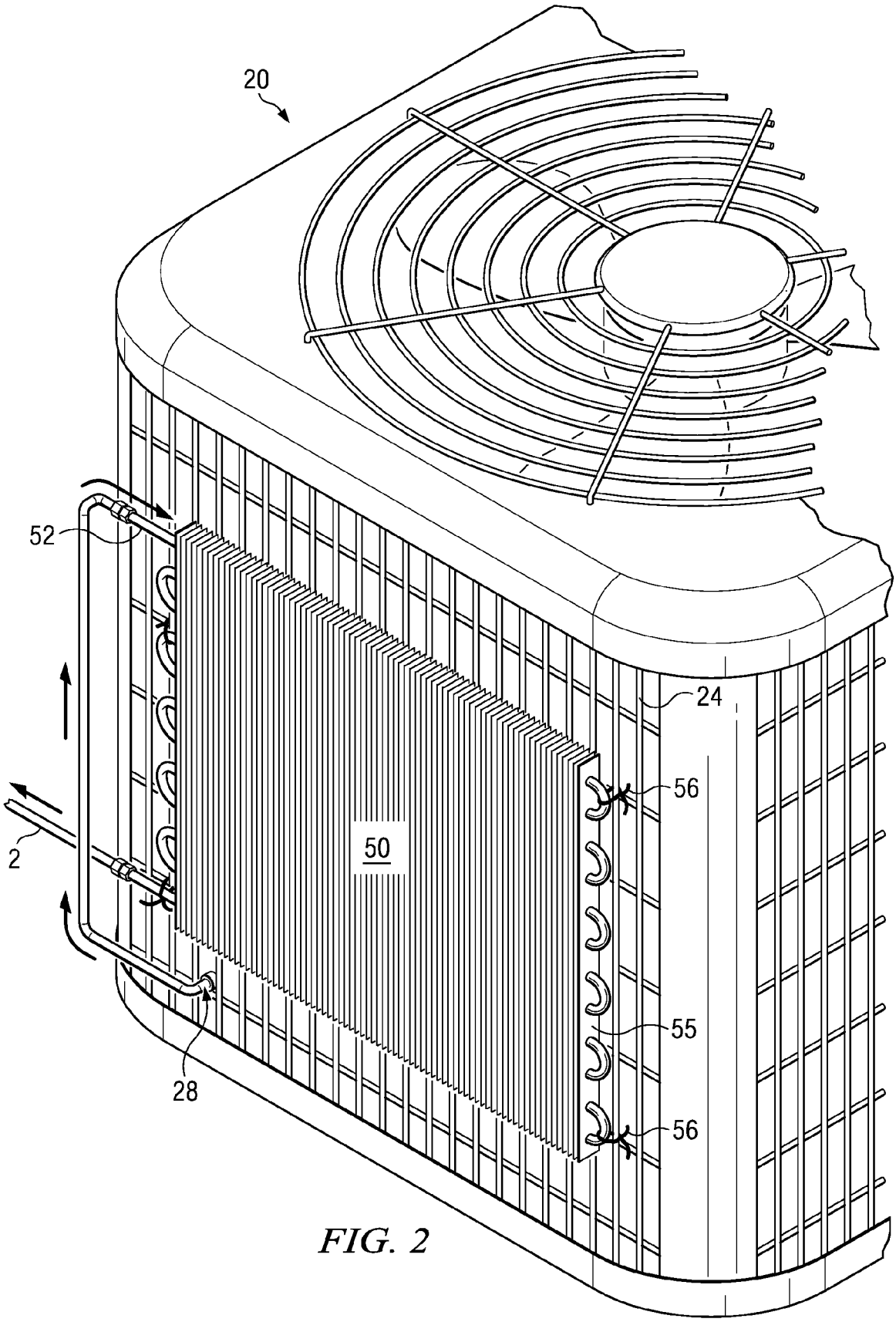
FIG. 2 a perspective view of the accessory sub-cooling unit of the present invention mounted to the condenser unit of a vapor-compression refrigeration system.
Figure 3A:
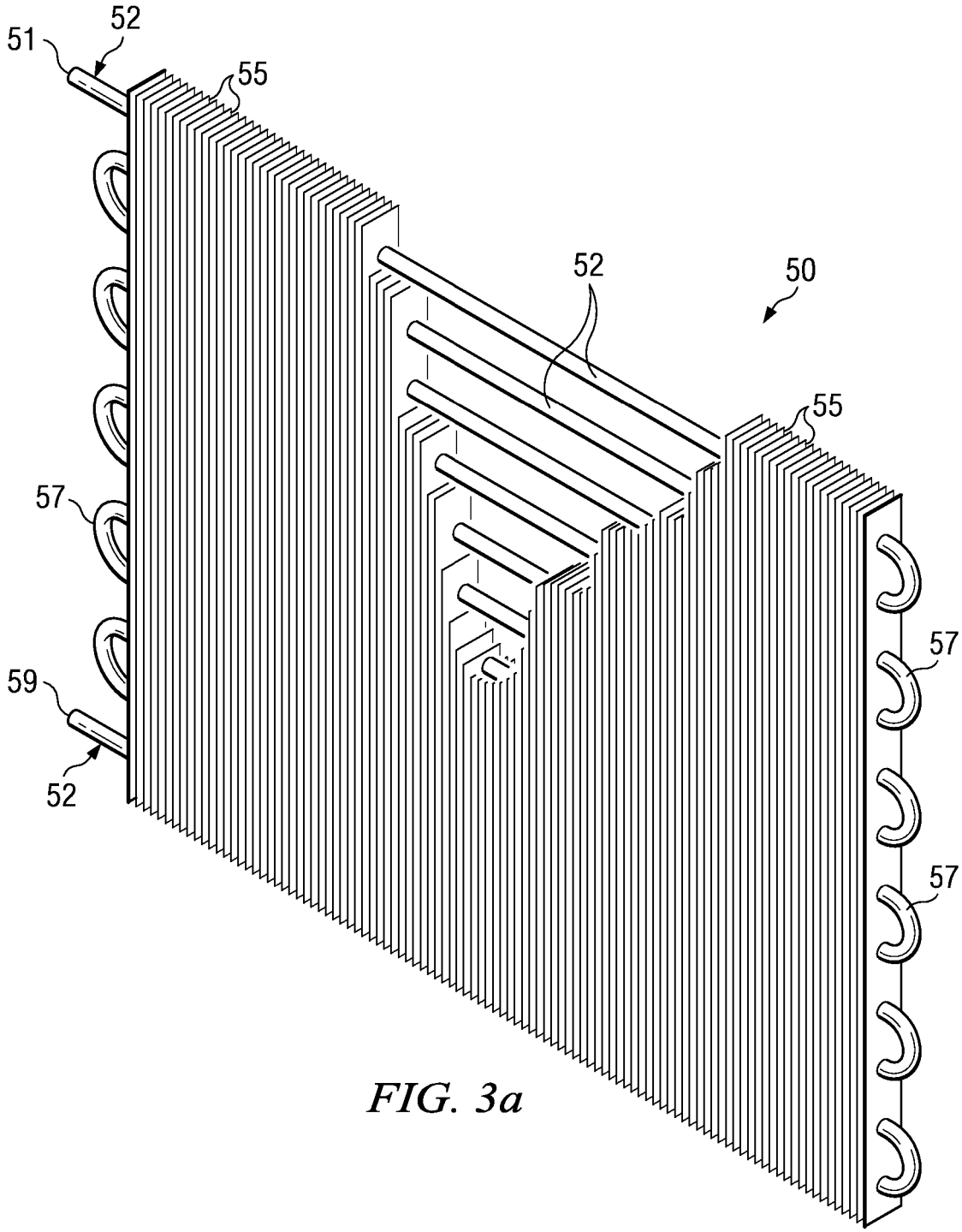
FIG. 3*a* is a partial cut-away perspective view of the accessory sub-cooling unit of the present invention.
Figure 3B:
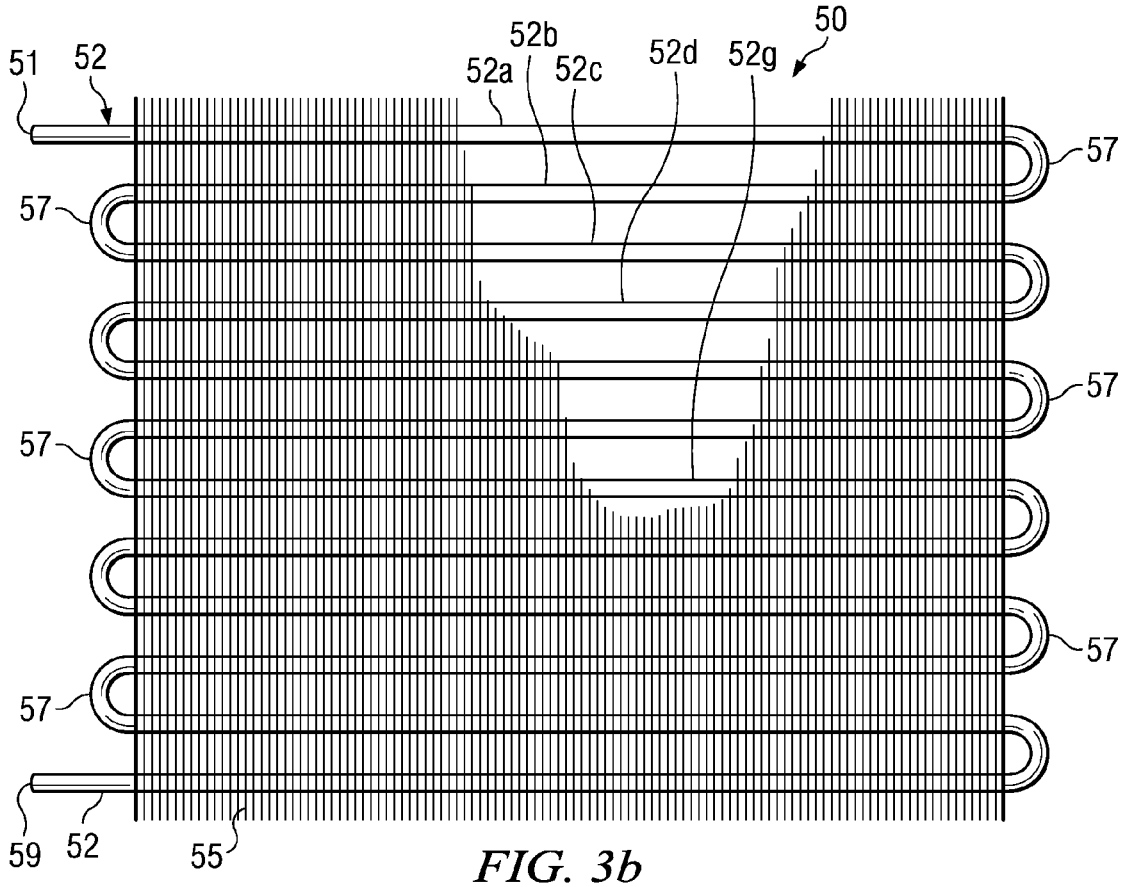
FIG. 3*b* is a partial cut-away front elevation view of the accessory sub-cooling unit of the present invention shown in FIG. 3*a*.

With reference to FIGS. 2, 3*a* and 3*b*, an embodiment of the accessory sub-cooling unit 50 of the present invention is shown. The unit 50 is mounted to the exterior of the condenser unit 20 of a vapor-compression refrigeration system. The accessory sub-cooling unit 50 comprises a serpentine heat exchange tube 52 fluidly connected downstream of the condensing unit 20 in a closed loop refrigeration system utilizing a vapor-compression refrigeration cycle. The heat exchange tube 52 includes an inlet 51 and an outlet 59. The inlet 51 is fluidly connected to the outlet 28 of the condensing coil 22 of the condenser unit 20. The outlet 59 of heat exchange tube 52 is fluidly connected to the conduit 2, which is, in turn, fluidly connected to the throttling or expansion valve located in the air handler 12 of a vapor-compression refrigeration cycle.

In a preferred embodiment, the heat exchange tube 52 comprises a plurality of parallel spaced refrigerant tubes 52*a*, 52*b*, 52*c*, etc. connected in series to one another by means of curved tubes or return bends 57. In the embodiment depicted in the Figures, the accessory sub-cooling unit 50 comprises a heat exchanger that is twelve tubes tall.

The accessory sub-cooling unit 50 further includes a plurality of parallel planar heat transfer fins 55 attached to the heat exchange tube 52, which facilitate the transfer of heat from the heat exchange tube 52 to the ambient air. As shown in the Figures, the planar heat transfer fins 55 traverse the heat exchange tube 52 and are each attached at multiple points to maximize the heat transfer from the heat exchange tube 52 to the fins 55. Moreover, the cross section of the heat transfer fins 55 may include a high pitch corrugation formed therein to improve stiffness characteristics of the heat transfer fins 55. As shown in FIG. 3*b*, the heat transfer fins 55 are evenly spaced along the length of the heat exchange tube 52 so that air may freely pass through. In a preferred embodiment, the heat transfer fins 55 are constructed of aluminum having a thickness of approximately 0.006 inch and spaced approximately ten fins per inch.

In one embodiment, the heat exchange tube 52 comprises copper tubing and the heat transfer fins 55 are constructed of aluminum. In a preferred embodiment of the accessory sub-cooling unit 50 of the present invention, the copper tubing has a diameter of approximately ⅜ inch and a wall thickness of approximately 0.014 inch.

Figure 4:
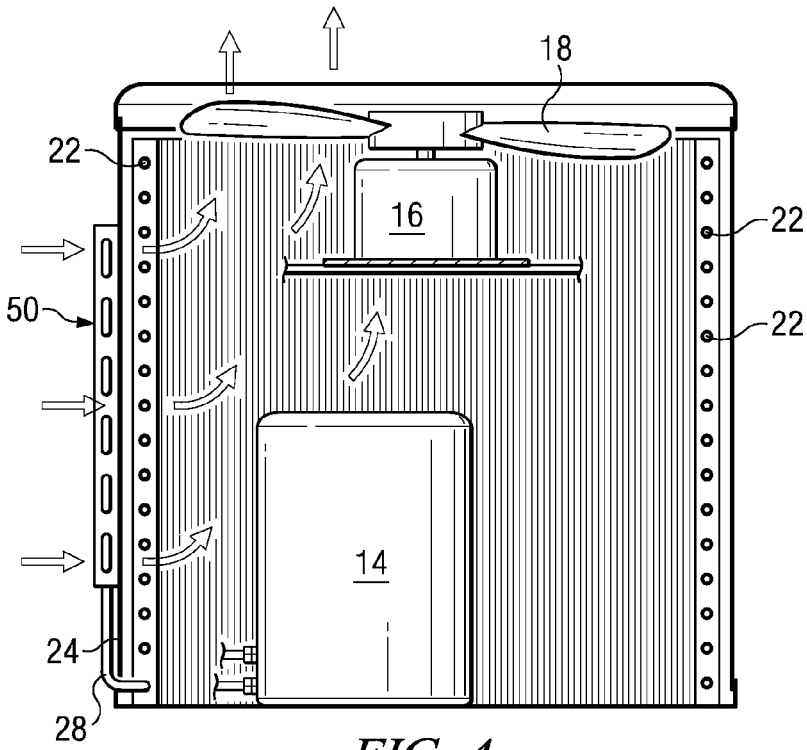
FIG. 4 is a cross-sectional view of accessory sub-cooling unit of the present invention mounted to the condenser unit shown in FIG. 2.

With reference now to the Figures and in particular FIGS. 2 and 4, in accordance with the method of the present invention, the accessory sub-cooling unit 50 is mounted to a side of the condenser unit 20 so as to utilize the existing air flow generated by the exhaust fan 16 of the condenser unit 20. For example, as depicted in the embodiment shown in the Figures, the accessory sub-cooling unit 50 is mounted to the condenser unit 20 by means of metal ties 56 fastening the heat exchange tube 52 to the protective wire grate 24 of the condenser unit 20. Thus, the accessory sub-cooling unit 50 is positioned on the exterior of the condenser unit 20. As best depicted in FIG. 4, in accordance with the method of the present invention, an air flow (shown generally as arrows) is generated by the exhaust fan 18 of the condenser unit 20. Due to the positioning of the accessory sub-cooling unit 50 relative to the condenser unit 20, a portion of the air flow is inherently drawn through the sub-cooling unit 50 prior to it being drawn through the condensing coil 22 of the condenser unit 20.

Testing of the accessory sub-cooling unit 50 of the present invention reveals that it causes minimal restriction of the airflow to the condensing coil 22 and it is not detrimental to the operation of the existing condenser unit 20. The results of one test disclosed the following parameter results:

- 12"×16"–1 row, 10 fpi, 95° F. entering air, 120° F. entering refrigerant liquid, 42,000 BTUH system, 1105 lbs./hr. refrigerant flow.
- 500 fpm fv, 1 circuit, 3414 BTUH, 112.4° F. leaving refrigerant, 7.3° F. subcooling.
- Pressure drop 4.2 psi or 9.7 ft. head.
- 400 fpm fv, 2 circuit, 2807 BTUH, 113.7° F. leaving refrigerant, 6.3° F. subcooling Pressure drop 0.61 psi or 1.4 ft. head.

Thus, the novel features of the present invention include that it subcools the liquid refrigerant exiting the condensing coil and that it utilizes the existing air flow generated by the exhaust fan of the condenser unit. In addition, the accessory sub-cooling unit of the present invention is inexpensive, easy to install. Once installed the vapor-compression refrigeration system is again a closed loop system. Moreover, once installed the accessory sub-cooling unit 50 of the present invention requires no additional energy to operate in accordance with the method of the invention. Thus, additional maintenance is minimal. By efficiently subcooling the liquid refrigerant exiting the condensing coil 22, the accessory sub-cooling unit 50 of the present invention increases the refrigerating capacity of the compressor unit.

It will now be evident to those skilled in the art that there has been described herein an improved method and apparatus for subcooling refrigerant in a vapor-compression refrigeration system. Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

The invention claimed is:

1. A method for improving the efficiency of an air conditioning system utilizing a condensable refrigerant in a vapor-compression refrigeration cycle having a condenser unit and a separate air handler unit connected in serial flow refrigerant circuitry, said condenser unit including a compressor, a condensing coil, and a fan to generate an air flow through said condensing coil to disperse heat generated by the system, wherein said method comprises:

mounting an accessory sub-cooling unit to an exterior surface of said condenser unit, said accessory sub-cooling unit comprising a serpentine heat exchange tube having an inlet and an outlet, fluidly connecting the inlet of said accessory sub-cooling unit to an outlet of said condensing coil fluidly connecting the outlet of said accessory sub-cooling unit to a conduit fluidly connected to said air handler unit, positioning said accessory sub-cooling unit relative to said condensing coil so as to utilize an existing air flow generated across said condensing coil by said fan to lower the temperature of said condensable refrigerant as it passes through said accessory sub-cooling unit.

2. An air conditioning system utilizing a condensable refrigerant in a vapor-compression refrigeration cycle, comprising in serial fluid communication:

a compressor unit having a compressor for compressing said refrigerant from a low-pressure superheated vapor state to a high-pressure superheated vapor, a condensing coil for receiving said high-pressure superheated refrigerant vapor from said compressor and condensing said refrigerant to a high pressure liquid state, an exhaust fan or generating a first airflow over said condensing coil to assist in transferring heat from said condensing coil when condensing said refrigerant;

an accessory sub-cooling unit for receiving and sub-cooling said refrigerant in a high pressure liquid state from said condensing coil, said accessory sub-cooling unit comprising a heat exchange tube having a plurality of heat transfer fins attached thereto, said heat exchange tube having an inlet fluidly connected to an outlet of said condensing coil, wherein said accessory sub-cooling unit is configured relative to said compressor unit so that a portion of said first airflow generated by said exhaust fan also passes over said accessory sub-cooling unit prior to passing over said condensing coil; and an air handler unit, separate and remote from said compressor unit, but fluidly connected to said compressor unit by a first conduit connected to an outlet of the heat exchange tube of said accessory sub-cooling unit, which supplies subcooled refrigerant in a high pressure liquid state from said accessory sub-cooling unit to said air handler unit, and a second conduit which returns vaporized low pressure refrigerant from the air handler unit back to said compressor.

3. An accessory sub-cooling unit for improving the efficiency of a split-system air conditioning system utilizing a condensable refrigerant in a vapor-compression refrigeration cycle, and having a compressor unit and an air handler unit connected in serial flow refrigerant circuitry, said accessory sub-cooling unit comprising:

a serpentine heat exchange tube having a plurality of heat transfer fins traversing and attached thereto, said heat exchange tube being fluidly connected to said refrigerant circuitry down stream of a condensing coil in said compressor unit and up stream of said air handler unit, wherein said accessory sub-cooling unit is configured so that a portion of an airflow generated by an exhaust fan in said compressor unit passes over said heat exchange tube prior to passing over said condensing coil.

4. The accessory sub-cooling unit of claim 3, wherein said heat exchange tube comprises a plurality of parallel spaced refrigerant tubes connected in series by tubes that are curved 180° along their length.

5. The accessory sub-cooling unit of claim 3, wherein said heat exchange tube is constructed of copper and said heat transfer fins are constructed of aluminum.

6. The accessory sub-cooling unit of claim 3, wherein said heat transfer fins are spaced along the length of said heat exchange tube approximately ten fins per inch.

* * * * *

UNITED STATES PATENT AND TRADEMARK OFFICE

CERTIFICATE OF CORRECTION

PATENT NO. : 8,146,373 B2
APPLICATION NO. : 12/401227
DATED : April 3, 2012
INVENTOR(S) : Amos A. Snow, III It is certified that error appears in the above-identified patent and that said Letters Patent is hereby corrected as shown below:

In the Claims:

Column 6, line 58, please delete "or" and replace it with --for--.

Signed and Sealed this
Twenty-ninth Day of January, 2013

David J. Kappos

David J. Kappos
*Director of the United States Patent and Trademark Office*